US009714104B2

(12) United States Patent
Alessandri et al.

(10) Patent No.: US 9,714,104 B2
(45) Date of Patent: Jul. 25, 2017

(54) PACKING METHOD FOR APPLYING A HEAT-SEAL OVERWRAP TO A HINGED-LID, SLIDE-OPEN PACKAGE OF TOBACCO ARTICLES

(71) Applicant: G.D SOCIETA' PER AZIONI, Bologna (IT)

(72) Inventors: Fabrizio Alessandri, Bologna (IT); Luca Petrucci, Castelfranco Emilia (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 530 days.

(21) Appl. No.: 14/356,400

(22) PCT Filed: Nov. 7, 2012

(86) PCT No.: PCT/IB2012/056243
§ 371 (c)(1),
(2) Date: May 6, 2014

(87) PCT Pub. No.: WO2013/068952
PCT Pub. Date: May 16, 2013

(65) Prior Publication Data

US 2014/0305082 A1 Oct. 16, 2014

(30) Foreign Application Priority Data

Nov. 7, 2011 (IT) ..... BO2011A0631

(51) Int. Cl.
*B65B 19/22* (2006.01)
*B65B 51/14* (2006.01)
(Continued)

(52) U.S. Cl.
CPC ..... *B65B 19/22* (2013.01); *B65B 11/12* (2013.01); *B65B 11/48* (2013.01); *B65B 51/14* (2013.01); *B65B 49/04* (2013.01)

(58) Field of Classification Search
CPC ..... B65B 11/12; B65B 11/22; B65B 11/48; B65B 19/22; B65B 49/02; B65B 49/04;
(Continued)

(56) References Cited

U.S. PATENT DOCUMENTS 3,041,806 A * 7/1962 Burt ..... B65B 11/22 53/172
3,115,731 A * 12/1963 Blythe ..... B29C 66/0044 156/359
(Continued)

FOREIGN PATENT DOCUMENTS

DE 10 2007 009 251 A1 8/2008
EP 0 970 889 A1 1/2000

OTHER PUBLICATIONS

International Search Report for International Patent Application No. PCT/IB2012/056243, dated Mar. 13, 2013.

*Primary Examiner* — Hemant M Desai
*Assistant Examiner* — Eduardo R Ferrero
(74) *Attorney, Agent, or Firm* — Marshall, Gerstein & Borun LLP

(57) ABSTRACT

A packing method for applying a heat-seal overwrap to a package of tobacco articles having an inner container, which houses a group of tobacco articles; an outer container housing the inner container in sliding manner; and a hinged lid, which closes an open top end of the inner container; the packing method including the steps of folding a sheet of heat-seal wrapping material into a tube about the package to form a tubular wrapping; folding two ends of the tubular wrapping to complete the overwrap; stabilizing the overwrap with two transverse heat seals; and, at least when
(Continued)

making the transverse heat seals, compressing a front wall of the outer container, so as to move at least part of a top edge of the front wall of the outer container beneath a top wall of the lid.

5 Claims, 7 Drawing Sheets

(51) Int. Cl.
*B65B 11/12* (2006.01)
*B65B 11/48* (2006.01)
*B65B 49/04* (2006.01)

(58) Field of Classification Search
CPC ..... B65B 19/226; B65B 19/223; B65B 19/20; B65B 19/18; B65B 2230/04; B65B 61/24
USPC ..... 54/461, 462, 463, 464, 465, 466, 449, 54/170, 171, 173, 203, 221, 209, 222, 54/223, 230, 233
See application file for complete search history.

(56) References Cited

U.S. PATENT DOCUMENTS 3,520,103 A * 7/1970 Stevens ..... B65B 11/12 493/157
3,643,396 A * 2/1972 Togashi ..... B65B 9/026 53/229
3,908,337 A * 9/1975 Zimmerman ..... B65B 49/08 53/206
3,979,881 A * 9/1976 Seragnoli ..... B65B 51/14 156/359
4,267,926 A * 5/1981 Toimil ..... B65D 85/1054 206/268
4,392,338 A * 7/1983 Fox ..... B65B 19/20 206/268
4,843,800 A * 7/1989 Focke ..... B65B 51/14 53/387.3
4,959,945 A * 10/1990 Rooyakkers ..... B65B 49/08 53/375.4
5,092,107 A * 3/1992 Lamm ..... B31B 1/28 493/110
5,123,226 A * 6/1992 Near ..... B65B 51/14 156/350
5,154,035 A * 10/1992 Cavazza ..... B29C 65/02 53/234
5,477,661 A * 12/1995 Draghetti ..... B29C 65/7882 53/234
5,533,323 A * 7/1996 Osti ..... B29C 65/02 53/225
5,613,344 A * 3/1997 Osti ..... B29C 65/02 53/228
5,701,725 A * 12/1997 Neri ..... B29C 65/1654 219/121.63
5,794,413 A * 8/1998 Draghetti ..... B65B 35/16 53/228
5,802,819 A * 9/1998 Boldrini ..... B65B 11/32 53/234
5,845,464 A * 12/1998 Draghetti ..... B65B 19/228 53/230
5,906,087 A * 5/1999 Boldrini ..... B65B 51/023 53/234
5,930,976 A * 8/1999 Boldrini ..... B65B 11/30 53/220
5,996,318 A * 12/1999 Draghetti ..... B65B 11/40 53/234
6,223,506 B1 * 5/2001 Ghini ..... B65B 51/14 53/232
6,263,644 B1 * 7/2001 Ghini ..... B65B 19/223 53/234
6,324,817 B1 * 12/2001 Ghini ..... B65B 19/225 53/233
6,381,921 B1 * 5/2002 Tale' ..... B65B 49/12 493/177
6,487,831 B1 * 12/2002 Turra ..... B65B 51/16 53/234
6,516,589 B1 * 2/2003 Draghetti ..... B29C 66/8226 53/376.7
6,643,996 B2 * 11/2003 Spatafora ..... B65B 19/225 53/228
7,093,711 B2 * 8/2006 Draghetti ..... B65D 85/1072 206/268
8,171,704 B2 * 5/2012 Boriani ..... B65B 19/223 53/442
8,745,962 B2 * 6/2014 Squarzoni ..... B65B 19/223 53/170
2004/0261368 A1 * 12/2004 Focke ..... B65B 19/18 53/449
2011/0023413 A1 * 2/2011 Suzuki ..... B65B 11/10 53/131.5

* cited by examiner

State of the Art

PACKING METHOD FOR APPLYING A HEAT-SEAL OVERWRAP TO A HINGED-LID, SLIDE-OPEN PACKAGE OF TOBACCO ARTICLES

CROSS-REFERENCE TO RELATED APPLICATIONS

This application is the U.S. national phase of PCT/IB2012/056243, filed Nov. 7, 2012, which claims the benefit of Italian Patent Application No. BO2011A000631, filed Nov. 7, 2011.

TECHNICAL FIELD

The present invention relates to a packing method for applying a heat-seal overwrap to a hinged-lid, slide-open package of tobacco articles.

In the following description, reference is made, for the sake of simplicity and purely by way of example, to a rigid, hinged-lid, slide-open packet of cigarettes.

BACKGROUND ART

Rigid, hinged-lid packets of cigarettes are currently the most widely marketed, by being easy to produce and easy and practical to use, and by effectively protecting the cigarettes inside.

In addition to the above rigid, hinged-lid packets of cigarettes, rigid slide-open packets have been proposed comprising two partly separable containers, one inserted inside the other. In other words, a rigid, slide-open packet of cigarettes comprises an inner container, which houses a foil-wrapped group of cigarettes and is housed inside an outer container to slide, with respect to the outer container, between a closed configuration, in which the inner container is inserted inside the outer container, and an open configuration, in which the inner container is extracted from the outer container.

A rigid, hinged-lid, slide-open packet of cigarettes has also been proposed in which the inner container has a lid hinged to rotate between a closed position and an open position closing and opening an open top end. The inner container lid has a connecting tab connected at one end to the lid, and at the other end to the outer container, to 'automatically' rotate the lid (i.e. without the user having to touch the lid) as the inner container slides with respect to the outer container.

Like all standard packets of cigarettes, rigid, hinged-lid, slide-open packets of cigarettes are wrapped in an overwrap made of transparent heat-seal material and having a tear-off strip. To apply the overwrap to the packet of cigarettes, a sheet of wrapping material is first folded into a tube about the packet of cigarettes to form a tubular wrapping, which is stabilized by a longitudinal heat seal and has two open ends at the top wall of the lid and the bottom wall of the outer container; the two ends of the tubular wrapping are then folded to complete the overwrap, and the two folded ends are then stabilized by corresponding transverse heat seals.

Each heat seal is made by subjecting the superimposed portions of the sheet of wrapping material to a combination of heat (to heat the wrapping material locally to above melting temperature) and pressure (to press firmly together and join the superimposed portions of the sheet of wrapping material); and heat and pressure are applied jointly by pressing a hot heat-seal pad onto the superimposed portions of the sheet of wrapping material, which are thus 'pinched' between the pad and the underlying wall of the packet of cigarettes. The underlying wall of the packet of cigarettes thus acts as a 'contrast member' onto which the pressure exerted by the heat-seal pad is transmitted.

In a rigid, hinged-lid, slide-open packet of cigarettes, there is often a gap between the top wall of the lid and the top wall of the underlying wrapped group of cigarettes (i.e. the top wall of the lid is a given distance from the top wall of the underlying wrapped group of cigarettes); and, when the heat-seal pad is pressed onto the top wall of the lid to stabilize the corresponding folded end of the overwrap, the top wall of the lid (which does not have the support of the top wall of the underlying wrapped group of cigarettes, due to the gap between them) may not be strong enough to withstand the pressure exerted by the heat-seal pad without collapsing and deforming significantly. The FIG. 7 schematic shows collapse of the top wall 12 of a lid 6 under the pressure of a heat-seal pad 29.

Significant deformation of the top wall of the lid under the pressure exerted by the heat-seal pad has two negative effects: firstly, it may be at least partly permanent, and so result in unsightly creasing of the top wall of the lid; and, secondly, it may at least partly impair the effectiveness of the heat-seal pad, and so result in a poor-quality heat seal.

DESCRIPTION OF THE INVENTION

It is an object of the present invention to provide a packing method for applying a heat-seal overwrap to a hinged-lid, slide-open package of tobacco articles, designed to eliminate the above drawbacks, and which in particular is cheap and easy to implement.

According to the present invention, there is provided a packing method for applying a heat-seal overwrap to a hinged-lid, slide-open package of tobacco articles, as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
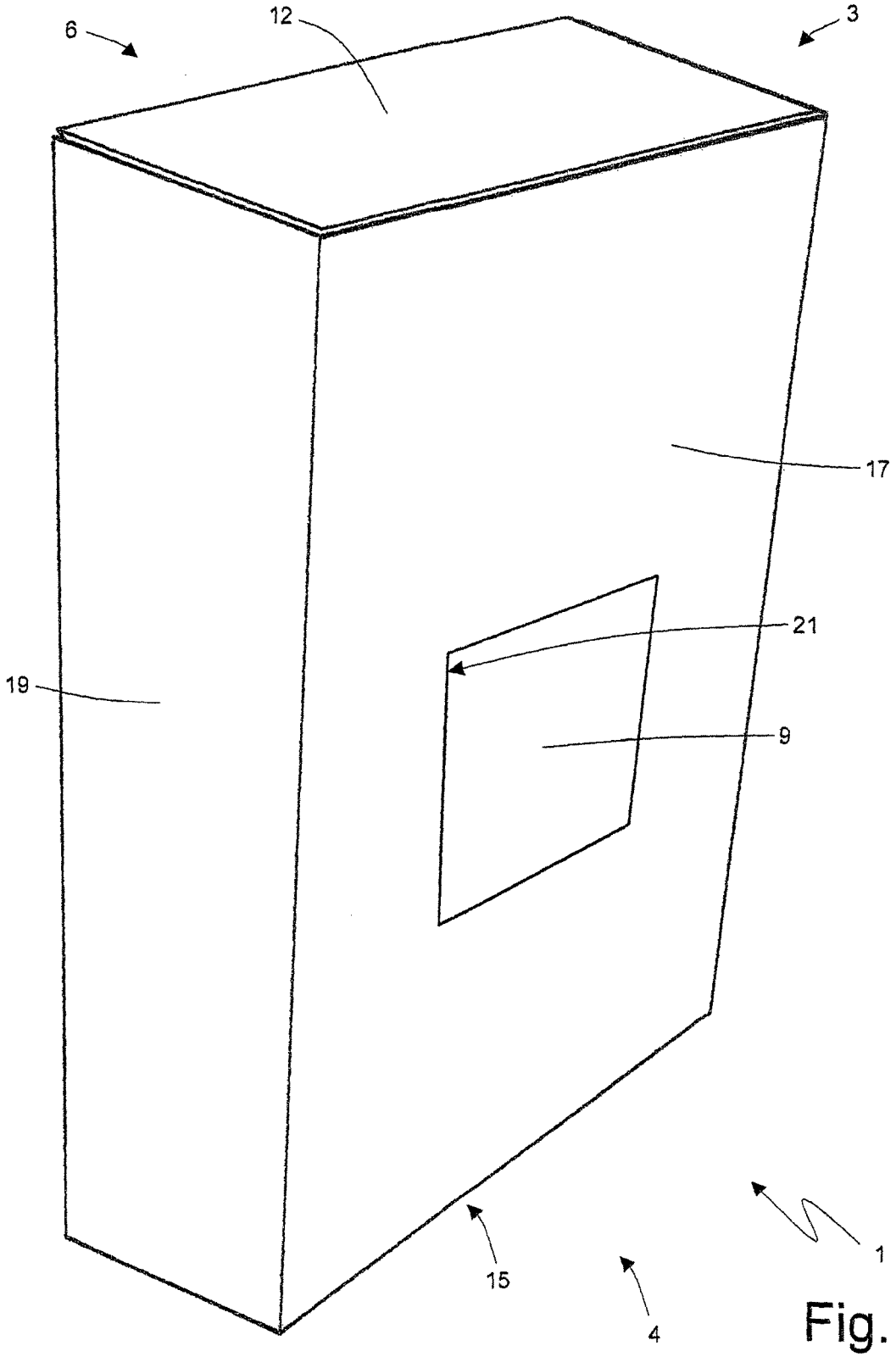
FIG. 1 shows a front view in perspective of a rigid, hinged-lid, slide-open packet of cigarettes in a closed configuration.
Figure 2:
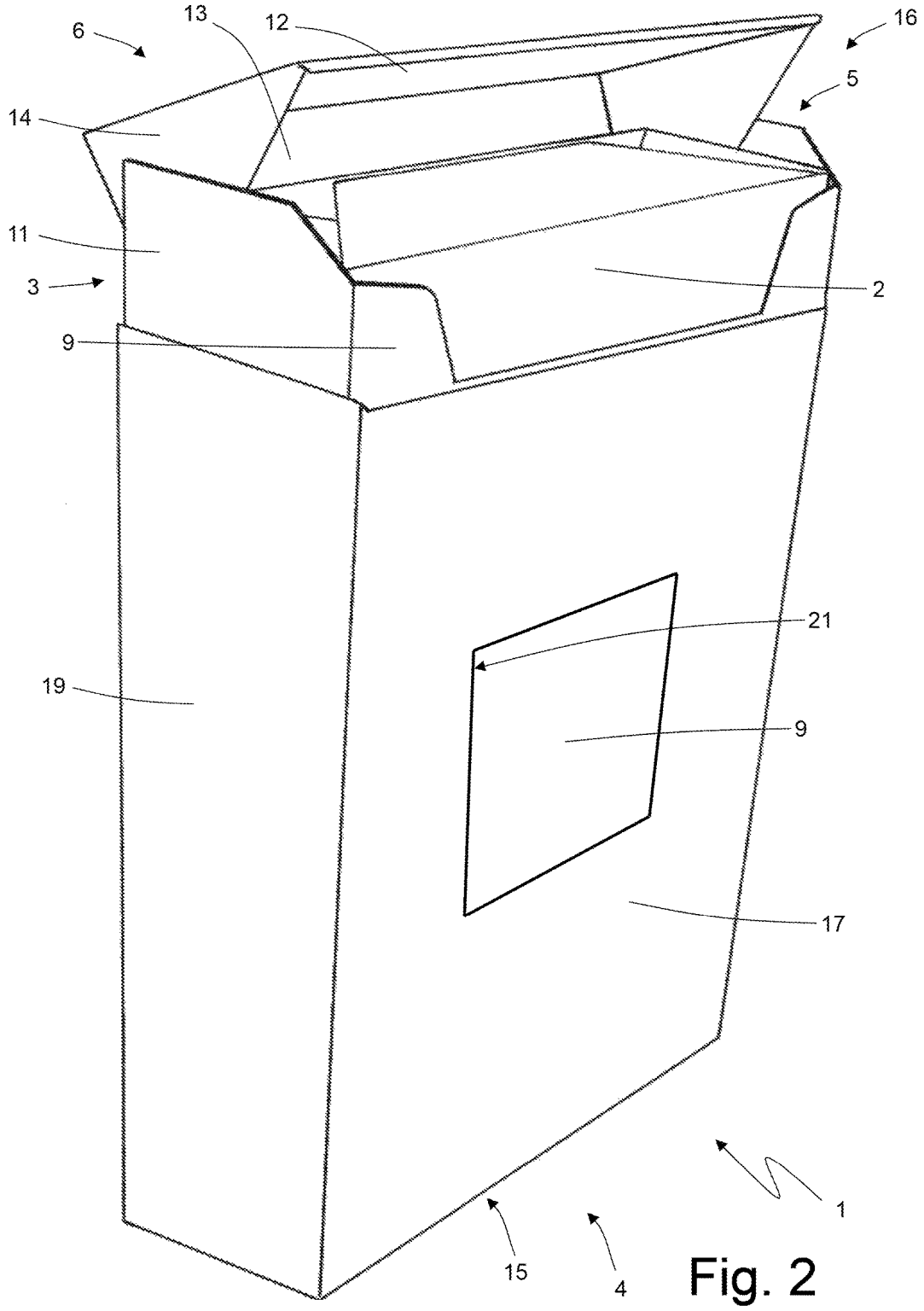
FIG. 2 shows a front view in perspective of the FIG. 1 packet of cigarettes in an open configuration.
Figure 3:
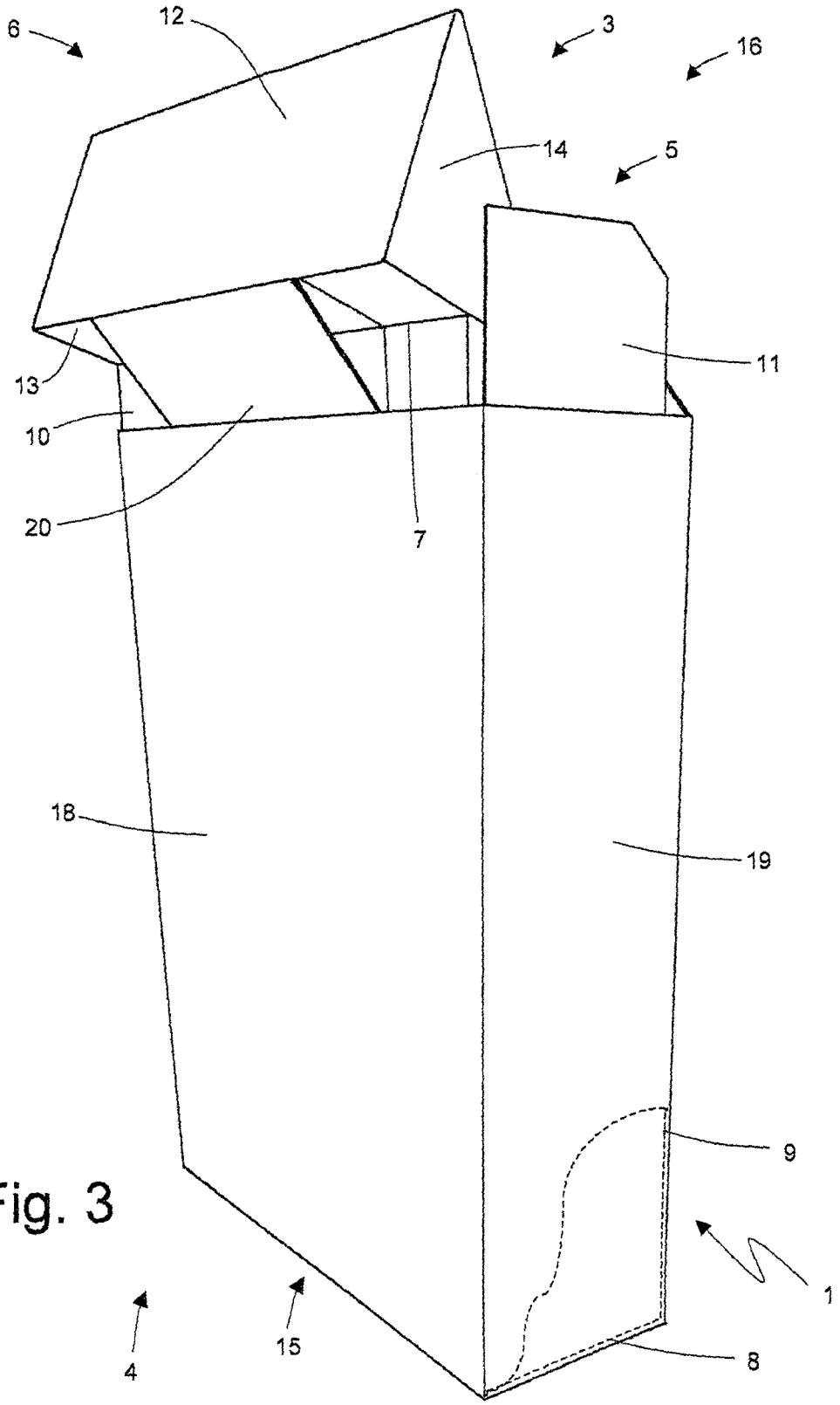
FIG. 3 shows a rear view in perspective of the FIG. 1 packet of cigarettes in an open configuration.

Number 1 in FIGS. 1, 2 and 3 indicates as a whole a rigid, slide-open packet of cigarettes, which opens in a translatory (linear) movement.

The FIG. 1 packet 1 of cigarettes comprises a wrapped, i.e. foil-wrapped group 2 of cigarettes (shown schematically in FIG. 2). Packet 1 of cigarettes also comprises a rigid inner container 3 actually containing the wrapped group 2 of cigarettes; and a rigid outer container 4, which houses inner container 3 to allow inner container 3 to slide in a translatory movement, with respect to outer container 4, between a closed configuration (FIG. 1), in which inner container 3 is inserted fully inside outer container 4, and an open configuration (FIGS. 2 and 3), in which inner container 3 is partly extracted from outer container 4 to allow access to wrapped group 2 of cigarettes.

Inner container 3 is parallelepiped-shaped with a rectangular cross section, is cup-shaped, and comprises an open top end 5. Inner container 3 comprises a cup-shaped lid 6 hinged to inner container 3 along a hinge 7 to rotate, with respect to inner container 3, between an open position (FIGS. 2 and 3) and a closed position (FIG. 1) opening and closing open top end 5 respectively.

Inner container 3 comprises a bottom wall 8 opposite open top end 5; a front wall 9 and rear wall 10 opposite and parallel to each other; and two parallel lateral walls 11 interposed between walls 9 and 10. Four longitudinal edges are defined between walls 9 and 10 and lateral walls 11; and four transverse edges are defined between walls 9, 10, 11 and bottom wall 8.

Lid 6 is cup-shaped, and comprises a top wall 12 (which is parallel to and opposite bottom wall 8 of inner container 3 when lid 6 is closed); a rear wall 13 connected to rear wall 10 of inner container 3 by hinge 7; and two parallel lateral walls 14.

Outer container 4 is cup-shaped, is parallelepiped-shaped with a rectangular cross section, and comprises a bottom wall 15 opposite an open top end 16; a front wall 17 and rear wall 18 opposite and parallel to each other; and two parallel lateral walls 19 interposed between walls 17 and 18. Four longitudinal edges are defined between walls 17 and 18 and lateral walls 19; and four transverse edges are defined between walls 17, 18, 19 and bottom wall 15.

As shown in FIG. 3, rear wall 13 (more specifically, a top edge of rear wall 13) of lid 6 is connected to rear wall 18 of outer container 4 by a connecting tab 20 to rotate lid 6 'automatically' (i.e. without the user having to touch lid 6) as inner container 3 slides with respect to outer container 4. In other words, by means of connecting tab 20 connecting rear wall 13 of lid 6 mechanically to rear wall 18 of outer container 4, inner container 3, as it slides with respect to outer container 4 from the closed to the open configuration, pushes lid 6 from the closed to the open position 'automatically' (i.e. without the user having to touch lid 6); and similarly, as inner container 3 slides with respect to outer container 4 from the open to the closed configuration, lid 6 is pushed by inner container 3 from the open to the closed position 'automatically' (i.e. without the user having to touch lid 6). The user therefore need simply exert sufficient thrust to slide inner container 3 with respect to outer container 4, without having to touch lid 6, which is rotated 'automatically'.

As shown in FIGS. 1 and 2, front wall 17 of outer container 4 has a through opening 21 allowing access to front wall 9 of inner container 3 to exert thrust on inner container 3 to move it between the closed and open configurations.

In the embodiment shown in the drawings, lid 6 is hinged to rear wall 10 of inner container 3; in a different embodiment not shown, lid 6 is hinged to rear wall 18 of outer container 4.

Figure 4:
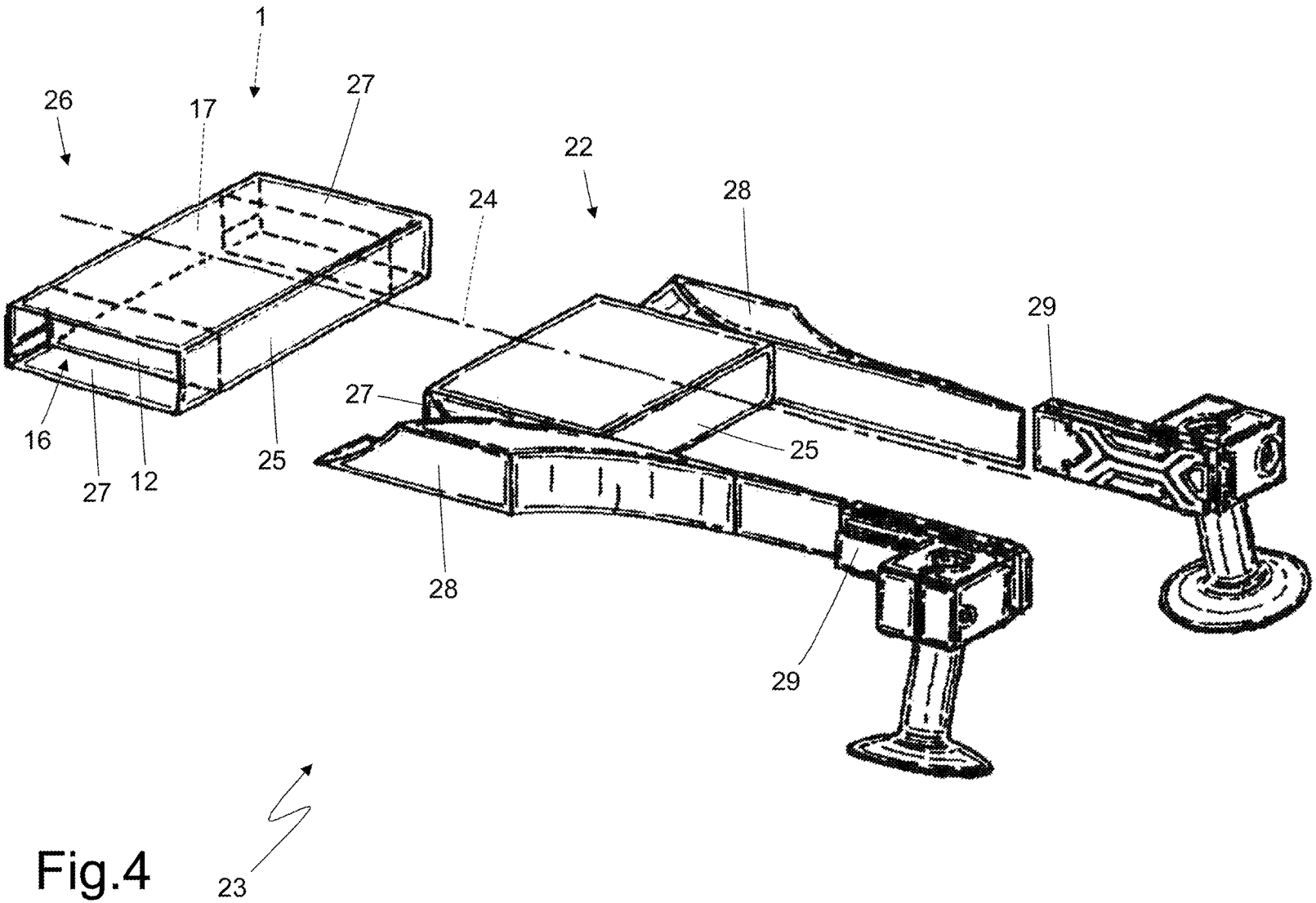
FIGS. 4 and 5 show two partial, schematic views in perspective of a packing station for applying a transparent overwrap about the FIG. 1 packet of cigarettes.
Figure 5:
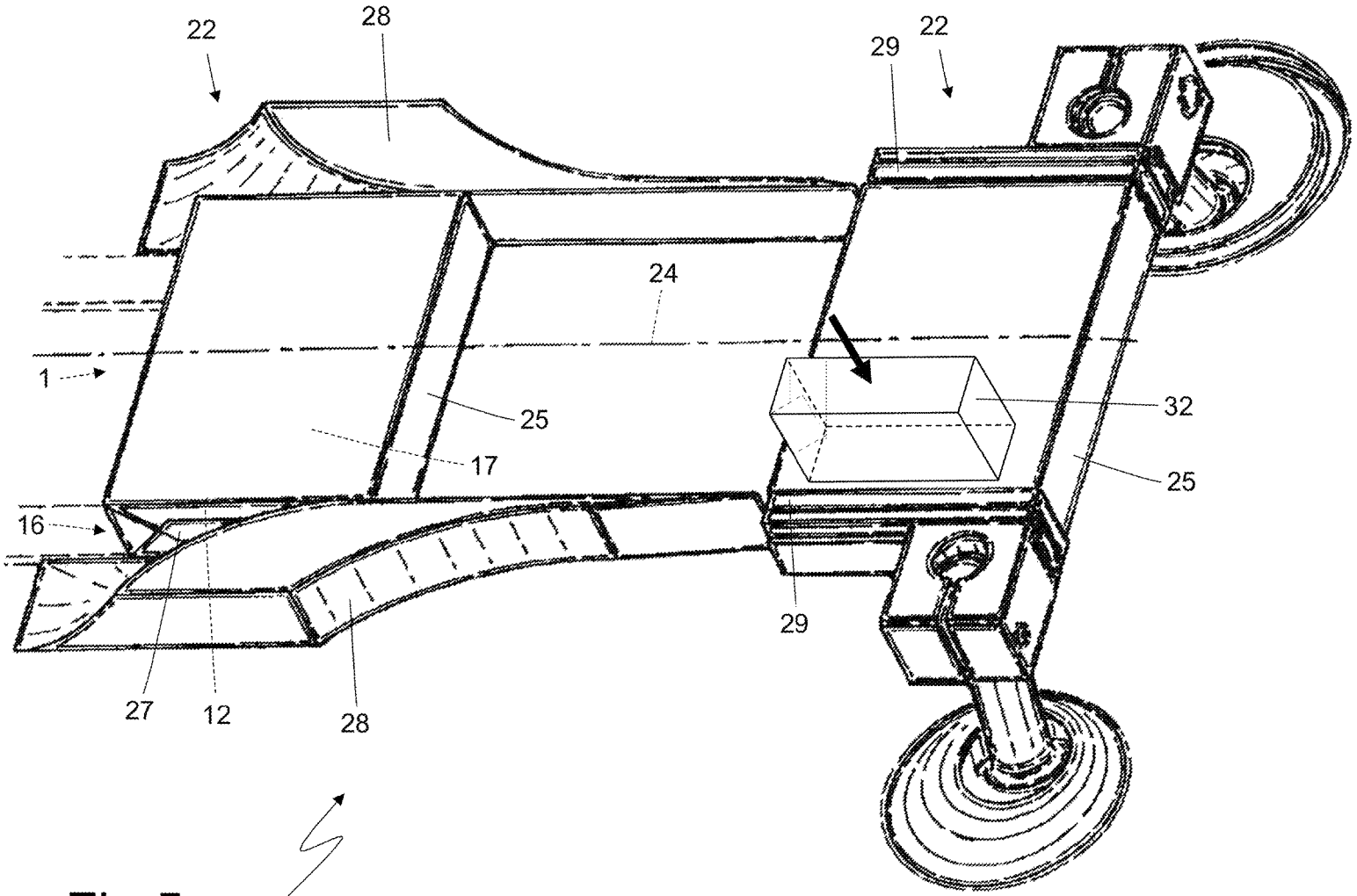

As shown in FIGS. 4 and 5, when completed, packet 1 of cigarettes is wrapped in an overwrap 22 made of transparent heat-seal material and having a tear-off strip.

Overwrap 22 is formed at a packing station 23 (only shown partly in FIGS. 4 and 5) where packet 1 of cigarettes is fed along a packing path 24. Along packing path 24, a sheet 25 of wrapping material is first folded into a tube about packet 1 of cigarettes to form a tubular wrapping 26, which is stabilized by a longitudinal heat seal (i.e. by heat sealing the superimposed portions of sheet 25 of wrapping material along a lateral wall 19 of outer container 4). Tubular wrapping 26 has two open ends 27 at the top wall 12 of lid 6 and the bottom wall 15 of outer container 4. To complete overwrap 22, the two ends 27 of tubular wrapping 22 are folded respectively onto top wall 12 of lid 6 and onto the bottom wall of package 1 by known folding devices (not shown) and ultimately by two fixed folding screws 28.

Immediately downstream from the two fixed folding screws 28, the two folded ends 27 are stabilized by a first transverse heat seal on the superimposed portions of sheet 25 of wrapping material on top wall 12 of lid 6, and by a simultaneous second transverse heat seal on the superimposed portions of sheet 25 of wrapping material on bottom wall 15 of outer container 4. Each transverse heat seal is made by subjecting the superimposed portions of sheet 25 of wrapping material to a combination of heat (to heat the wrapping material locally to above melting temperature) and pressure (to press firmly together and join the superimposed portions of sheet 25 of wrapping material); and heat and pressure are applied jointly by pressing a hot heat-seal pad 29 onto the superimposed portions of sheet 25 of wrapping material, which are thus 'pinched' between heat-seal pad 29 and the underlying wall 12, 15. The underlying wall 12, 15 thus acts as a 'contrast member' onto which the pressure exerted by heat-seal pad 29 is transmitted.

Figure 7:
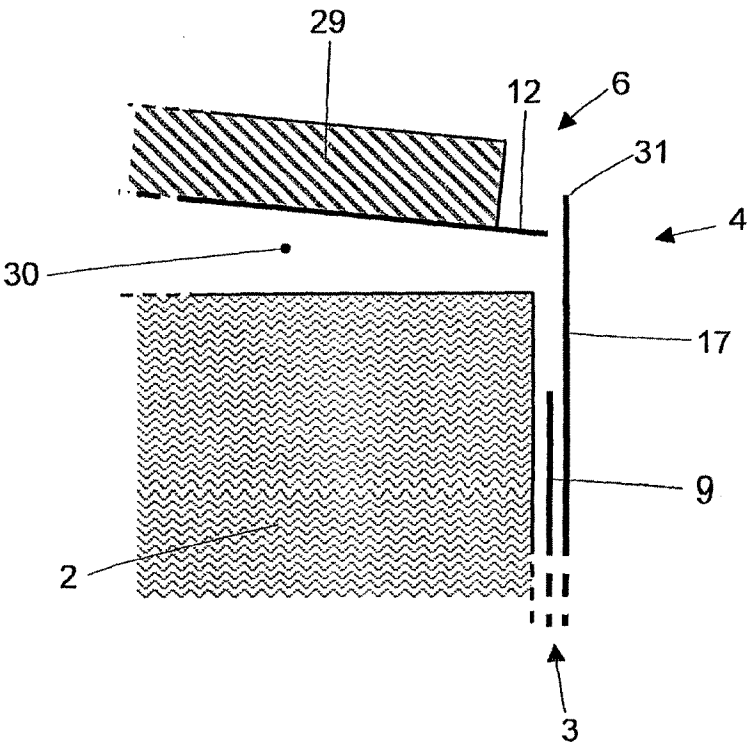
FIGS. 6 and 7 show two schematic longitudinal sections of a top portion of the FIG. 1 packet of cigarettes when transversely sealing the transparent overwrap in known manner in accordance with the known art.
Figure 6:
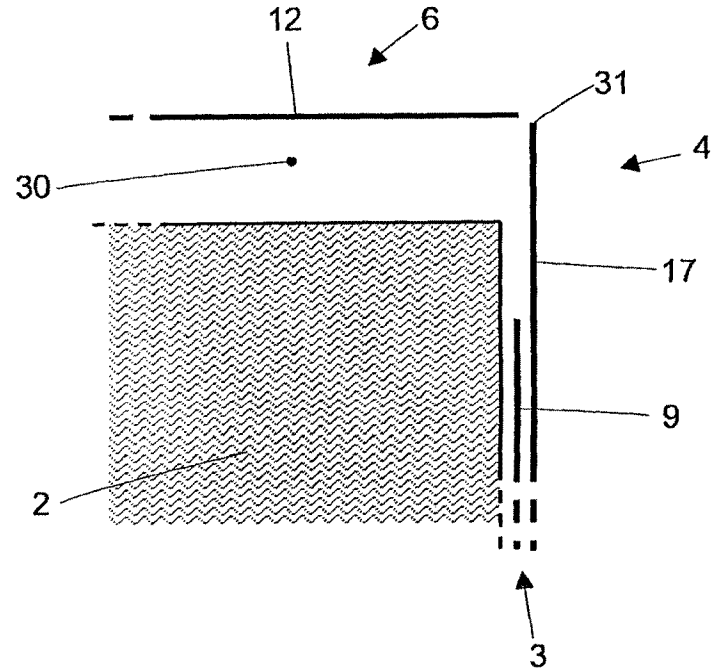

As shown in FIGS. 6 and 7, packet 1 of cigarettes has a small gap 30 (greatly enlarged in FIGS. 6 and 7 for the sake of clarity) between top wall 12 of lid 6 and the top wall of the underlying wrapped group 2 of cigarettes (i.e. top wall 12 of lid 6 is a given distance from the top wall of the underlying wrapped group 2 of cigarettes). Gap 30 is the result of the tolerance necessary for lid 6 to close completely without interfering with group 2 of cigarettes.

If no precautions are taken, when heat-seal pad 29 is pressed onto top wall 12 of lid 6 to stabilize the corresponding folded end 27 of overwrap 22, top wall 12 of lid 6 (which does not have the support of the top wall of the underlying wrapped group 2 of cigarettes, due to the gap between them) may not be strong enough to withstand the pressure exerted by heat-seal pad 29 without collapsing and deforming significantly. The FIG. 7 schematic shows collapse of top wall 12 of lid 6 under the pressure of heat-seal pad 29. Significant deformation of top wall 12 of lid 6 under the pressure exerted by heat-seal pad 29 has two negative effects: firstly, it may be at least partly permanent, and so result in unsightly creasing of top wall 12 of lid 6; and, secondly, it may at least partly impair the effectiveness of heat-seal pad 29, and so result in a poor-quality heat seal.

Figure 9:
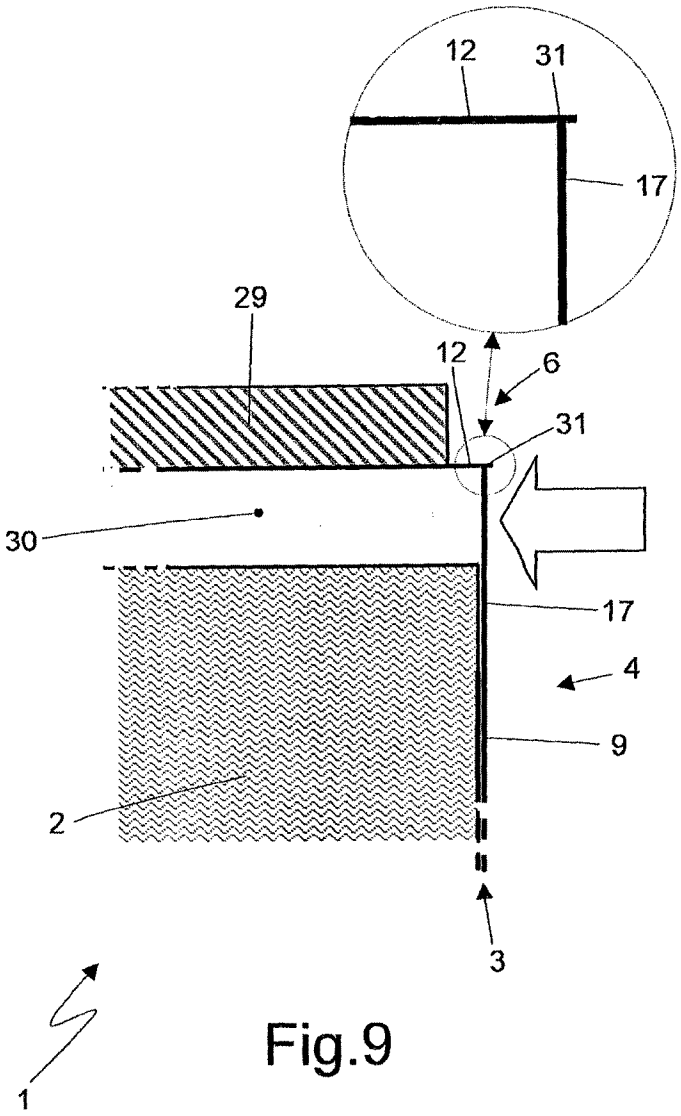
FIGS. 8 and 9 show two schematic longitudinal sections of a top portion of the FIG. 1 packet of cigarettes when transversely sealing the transparent overwrap in accordance with the present invention.
Figure 8:
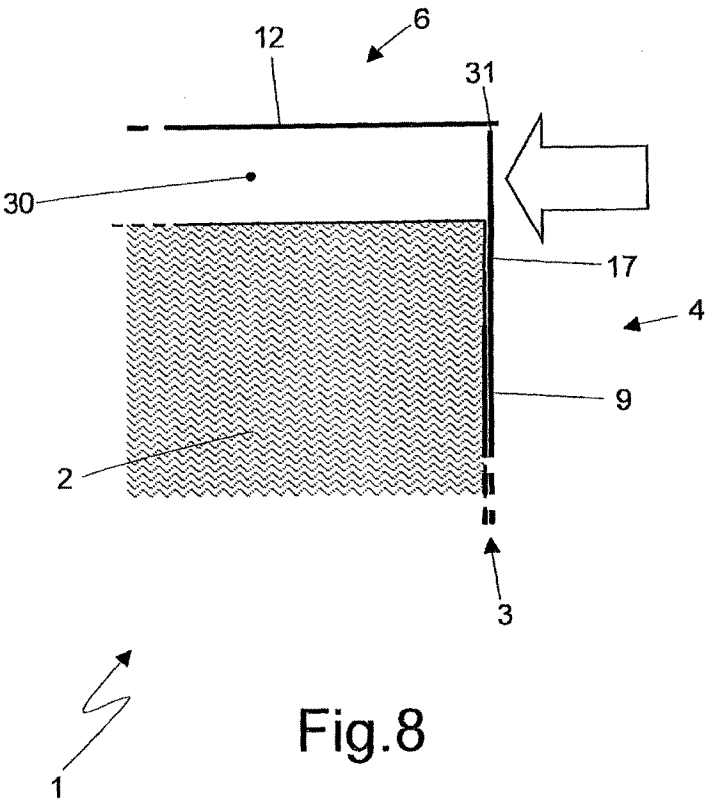

In accordance with the present invention, and as shown in FIGS. 8 and 9, front wall 17 of outer container 4 is compressed, at least when making the first transverse heat seal on top wall 12 of lid 6, so as to move a top edge 31 of front wall 17 of outer container 4 beneath top wall 12 of lid 6. When pressed by heat-seal pad 29, top wall 12 of lid 6 therefore has the 'support' of top edge 31 of front wall 17 of outer container 4 (as shown clearly in FIG. 9), and is thus prevented from collapsing and deforming under the pressure of heat-seal pad 29. In other words, top edge 31 of front wall 17 of outer container 4 is normally located outwards of top wall 12 of lid 6 (as shown in FIGS. 6 and 7), so, when top wall 12 of lid 6 is pressed down by heat-seal pad 29, top wall 12 is in no way supported by front wall 17 of outer container 4 (as shown in FIG. 7); whereas, in the present invention, front wall 17 of outer container 4 is moved inwards to position top edge 31 beneath top wall 12 of lid 6 (with a given margin of safety), so front wall 17 of outer container 4 acts as a 'support' for top wall 12 of lid 6 (as shown in FIG. 9).

Obviously, not all of top edge 31 of front wall 17 of outer container 4 can be moved beneath top wall 12 of lid 6, on account of front wall 17 of outer container 4 being laterally integral with lateral walls 19; when compressed, front wall 17 of outer container 4 deforms into an 'arc' shape, with maximum deformation at the centre and practically no deformation at the two sides. So, only the middle portion of top edge 31 of front wall 17 of outer container 4 is moved beneath top wall 12 of lid 6.

Obviously, compressing front wall 17 of outer container 4 also compresses front wall 9 of inner container 3 located beneath front wall 17 of outer container 4. So, front wall 9 of inner container 3 also deforms in the same way as front wall 17 of outer container 4. The pressure exerted on the two front walls 9 and 17 is minimum, and in no way damages the cigarettes in wrapped group 2 inside inner container 3.

In one embodiment, front wall 17 of outer container 4 is only compressed when making the first transverse heat seal on top wall 12 of lid 6, by applying a pressure device 32 (shown schematically in FIG. 5) on front wall 17 of outer container 4, close to lid 6. In this embodiment, pressure device 32 is pressed onto front wall 17 of outer container 4 just before pressing heat-seal pad 29 onto top wall 12 of lid 6, and is removed from front wall 17 of outer container 4 as soon as heat-seal pad 29 is removed from top wall 12 of lid 6.

In an alternative embodiment, front wall 17 of outer container 4 is compressed when forming tubular wrapping 26, and remains compressed by tubular wrapping 26 itself. More specifically; front wall 17 of outer container 4 is compressed by tightening tubular wrapping 26 about packet 1 of cigarettes, i.e. front wall 17 of outer container 4 is compressed by the tension exerted on tubular wrapping 26 and which slightly 'squeezes' packet 1 of cigarettes. In this embodiment, front wall 17 of outer container 4 remains compressed until overwrap 22 either slackens naturally or is removed.

The packing method described has numerous advantages.

Above all, the packing method described effectively prevents top wall 12 of lid 6 from collapsing under the pressure of heat-seal pad 29.

Moreover, the packing method described is cheap and easy to implement, by even its most complex embodiment only requiring a pressure device 32 with one degree of freedom in an area with no particular space restrictions (i.e. in a substantially 'clear' area).

The invention claimed is:

1. A packing method for applying a heat-seal overwrap to a package of tobacco articles; the package comprising: an inner container, which houses a group of tobacco articles, comprising a front wall, an oppositely disposed rear wall extending parallel to the front wall, and an open top end; an outer container housing the inner container so as to allow the inner container to slide with respect to the outer container between a closed configuration, in which the inner container is inserted inside the outer container, and an open configuration, in which the inner container is extracted partly from the outer container; and a hinged lid, which closes the open top end of the inner container, is hinged along a hinge, and comprises a top wall; wherein the outer container comprises a front wall facing the front wall of the inner container and an oppositely disposed rear wall facing the rear wall of the inner container and extending parallel to the front wall of the outer container; wherein the front wall of the outer container is, in the closed configuration, perpendicular to the top wall of the lid and is arranged opposite to the hinge of the lid; wherein the rear wall of the outer container is, in the closed configuration, perpendicular to the top wall of the lid and is arranged in correspondence of the hinge of the lid; and wherein the front wall of the outer container comprises a top edge, which, in the closed configuration, is arranged close to the top wall of the lid; the packing method comprising the steps of: folding a sheet of heat-seal wrapping material into a tube about the package to form a tubular wrapping having two open ends at the top wall of the lid and at an oppositely disposed bottom wall of the package; stabilizing the tubular wrapping by making a first heat seal on a lateral wall of the outer container, which is perpendicular to the front wall of the outer container and to the rear wall of the outer container; folding, after the stabilization by the first heat seal, the two ends of the tubular wrapping onto the top wall of the lid and onto the bottom wall of the package to complete the overwrap; stabilizing the overwrap by making a second heat seal on superimposed portions of the sheet of wrapping material on the top wall of the lid, and a third heat seal on superimposed portions of the sheet of wrapping material on the bottom wall of the package; and compressing, at least when making the second heat seal, the front wall of the outer container towards the hinge of the lid, so as to move at least part of the top edge of the front wall of the outer container beneath the top wall of the lid so that the top wall of the lid can lean against the top edge of the front wall of the outer container.

2. A packing method as claimed in claim 1, wherein the front wall of the outer container is compressed by applying a pressure device on the front wall of the outer container and close to the lid when making the first heat seal.

3. A packing method as claimed in claim 1, wherein the front wall of the outer container is compressed when forming the tubular wrapping and by tightening the tubular wrapping about the package, and is kept compressed forever by the tubular wrapping.

4. A packing method as claimed in claim 1, wherein the lid is hinged to the rear wall of the inner container.

5. A packing method as claimed in claim 1, wherein the lid is hinged to the rear wall of the outer container.

* * * * *